US008803653B2

(12) United States Patent
Tseng et al.

(10) Patent No.: US 8,803,653 B2
(45) Date of Patent: Aug. 12, 2014

(54) OVER-CURRENT PROTECTION DEVICE

(71) Applicants: Chun Teng Tseng, Sanwan Township, Miaoli County (TW); David Shau Chew Wang, Taipei (TW)

(72) Inventors: Chun Teng Tseng, Sanwan Township, Miaoli County (TW); David Shau Chew Wang, Taipei (TW)

(73) Assignee: Polytronics Technology Corp., Hsinchu (TW)

( * ) Notice: Subject to any disclaimer, the term of this patent is extended or adjusted under 35 U.S.C. 154(b) by 0 days.

(21) Appl. No.: 13/866,583

(22) Filed: Apr. 19, 2013

(65) Prior Publication Data

US 2014/0035718 A1 Feb. 6, 2014

(30) Foreign Application Priority Data

Jul. 31, 2012 (TW) ..... 101127716 A

(51) Int. Cl.

| | |
|---|---|
| ***H01C 7/10*** | (2006.01) |
| ***H01C 7/13*** | (2006.01) |
| ***H01C 7/02*** | (2006.01) |
| ***H01C 1/148*** | (2006.01) |
| ***H01C 7/18*** | (2006.01) |
| ***H01C 1/14*** | (2006.01) |

(52) U.S. Cl.

CPC ..... *H01C 7/02* (2013.01); *H01C 7/021* (2013.01); *H01C 1/148* (2013.01); *H01C 7/18* (2013.01); *H01C 1/1406* (2013.01)

USPC ..... 338/22 R

(58) Field of Classification Search

USPC ..... 338/22 R

See application file for complete search history.

(56) References Cited

U.S. PATENT DOCUMENTS

| | | | | |
|---|---|---|---|---|
| 4,414,530 | A * | 11/1983 | Bouffard et al. | 338/25 |
| 5,534,843 | A * | 7/1996 | Tsunoda et al. | 338/22 R |
| 6,188,308 | B1 * | 2/2001 | Kojima et al. | 338/22 R |
| 6,311,390 | B1 * | 11/2001 | Abe et al. | 29/612 |
| 6,809,626 | B2 * | 10/2004 | Chu et al. | 337/167 |

* cited by examiner

*Primary Examiner* — Kyung Lee

(74) *Attorney, Agent, or Firm* — Egbert Law Offices, PLLC

(57) ABSTRACT

An over-current protection device is of an approximately quadrilateral structure with upper and lower surfaces, first and second side surfaces, in which the second side surface contains a bevel. The device comprises first and second electrodes, a first PTC material layer, and first and second conductive connecting members. The first electrode is formed on the upper or lower surface. The second electrode is formed on the lower surface and is insulated from the first electrode. The first PTC material layer extends along the upper surface, and has a first surface electrically coupled to the first electrode, and a second surface electrically coupled to the second electrode. The first conductive connecting member is formed on the first side surface and is electrically coupled to the first electrode. The second conductive connecting member is formed on the second side surface and extends along the bevel to electrically couple to the second electrode.

22 Claims, 8 Drawing Sheets

OVER-CURRENT PROTECTION DEVICE

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present application relates to an over-current protection device, and more particularly to a thin-type over-current protection device.

2. Description of Related Art Including Information Disclosed Under 37 CFR 1.97 and 37 CFR 1.98.

Over-current protection devices are used for protecting circuitries from damage caused by over-heat, or over-current. An over-current protection device usually contains two electrodes and a resistive material disposed therebetween. The resistive material has positive temperature coefficient (PTC) characteristic that the resistance thereof remains extremely low at room temperature and instantaneously increases to thousand times when the temperature reaches a critical temperature or the circuit has over-current, so as to suppress over-current and protect the cell or the circuit device. When the resistive material gets back to the room temperature or over-current no longer exists, the over-current protection device returns to be of low resistance and as a consequence the circuitry again operate normally. In view of the reusable property, the PTC over-current protection devices can replace traditional fuses, and have been widely applied to high density circuits.

Electronic apparatuses are being made smaller. Therefore, it has to extremely restrict the sizes or thicknesses of active and passive devices in the electronic apparatus. According to cellular phone design, an over-current protection device usually is secured to a protective circuit module (PCM) board. The external electrodes connecting to the over-current protection device occupy a certain space, and therefore the over-current protection device has to be made thinner.

The over-current protection devices usually contain two stacked PTC devices connected in parallel in an attempt to lower the resistance of the over-current protection device. In FIG. 1, an over-current protection device 10 comprises two PTC devices 1 and 2. Each of the PTC devices 1 and 2 comprises metal foils 12*a*, 12*b* and a PTC material layer 11 disposed therebetween. The metal foils 12*a* of the PTC devices 1 and 2 are electrically connected to first electrodes 15 through a conductive connecting member 13, whereas the metal foils 12*b* are electrically connected to second electrodes 16 through a conductive connecting member 14. The metal foils 12*a*, 12*b* and the electrodes 15 and 16 are isolated by insulation layers 18. On the top and bottom surfaces of the device 10, solder masks 17 are formed between the electrodes 15 and the electrodes 16. Because the PTC device 1 and the PTC device 2 are connected in parallel the resistance of the over-current protection device 10 can decrease to meet the low-resistance requirement. However, the over-current protection device containing two stacked PTC devices is usually thick, resulting in difficulty to obtain a thinner structure.

BRIEF SUMMARY OF THE INVENTION

The present application relates to an over-current protection device, and more particularly to a thin-type over-current protection device.

In accordance with a first aspect of the present application an over-current protection device is of an approximately quadrilateral structure with an upper surface, a lower surface, a first side surface and a second side surface in cross-sectional view, in which at least the second side surface contains a bevel. The over-current protection device comprises a first electrode, a second electrode, a first PTC material layer, a first conductive connect member and a second conductive connecting member. The first electrode is formed on the upper or lower surface. The second electrode is formed on the lower surface and is insulated from the first electrode. The first PTC material layer extends along the upper surface, and has a first surface electrically coupled to the first electrode, and a second surface electrically coupled to the second electrode. The first conductive connecting member is formed on the first side surface and is electrically coupled to the first electrode. The second conductive connecting member is formed on the second side surface and extends along the bevel to electrically couple to the second electrode. In an embodiment, the bevel does not go through the second side surface completely; that is, the bevel is only a portion of the second side surface.

In an embodiment, the over-current protection device further comprises a first conductive member and a second conductive member. The first electrode and the second electrode are formed on the lower surface. The PTC material layer is laminated between the first conductive member and the second conductive member. The first conductive member is connected to the first conductive connecting member, and the second conductive member is connected to the second conductive connecting member. A solder mask is formed on the first conductive member to form the upper surface. In an embodiment, the over-current protection device further comprises a third conductive member and a fourth conductive member, a second PTC material layer, a first insulation layer and a second insulation layer. The third conductive member is connected to the first conductive connecting member, and the fourth conductive member is connected to the second conductive connecting member. The second PTC material layer is laminated between the third and fourth conductive members. A first insulation layer is formed between the second and third conductive members, and a second insulation layer is formed between the fourth conductive member and the first and second electrodes.

In accordance with a second aspect of the present application, an over-current protection device is of an approximately quadrilateral structure with an upper surface, a lower-surface, a first side surface and a second side surface in cross-sectional view, in which at least the second side surface contains a bevel. The over-current protection device comprises a first conductive connecting member, a second conductive connecting member, a first PTC device, a second PTC device and an insulation layer. The first conductive connecting member is formed on the first side surface and is electrically coupled to the first electrode. The second conductive connecting member is formed on the second side surface and extends along the bevel to electrically couple to the second electrode. The first PTC device and the second PTC device are stacked and the second PTC device is disposed below the first PTC device. An insulation layer is disposed between the first PTC device and the second PTC device. The first PTC device and the second PTC device are in parallel connection to the first and second conductive connecting members.

In an embodiment, a first electrode and a second electrode are formed on the lower surface. The upper metal foils of the first and second PTC devices are connected to the first conductive connecting member, and the lower metal foils of the first and second PTC devices are connected to the second conductive connecting member.

This novel design can be applied to over-current protection devices of a single or multiple PTC material layers, thereby effectively thinning the over-current protection devices to meet the rigorous requirements of compact electronic apparatuses.

BRIEF DESCRIPTION OF THE SEVERAL VIEWS OF THE DRAWINGS

The present application will be described according to the appended drawings in which.

DETAILED DESCRIPTION OF THE INVENTION

The making and using of the presently preferred illustrative embodiments are discussed in detail below. It should be appreciated, however, that the present application provides many applicable inventive concepts that can be embodied in a wide variety of specific contexts. The specific illustrative embodiments discussed are merely illustrative of specific ways to make and use the invention, and do not limit the scope of the invention.

Figure 2:
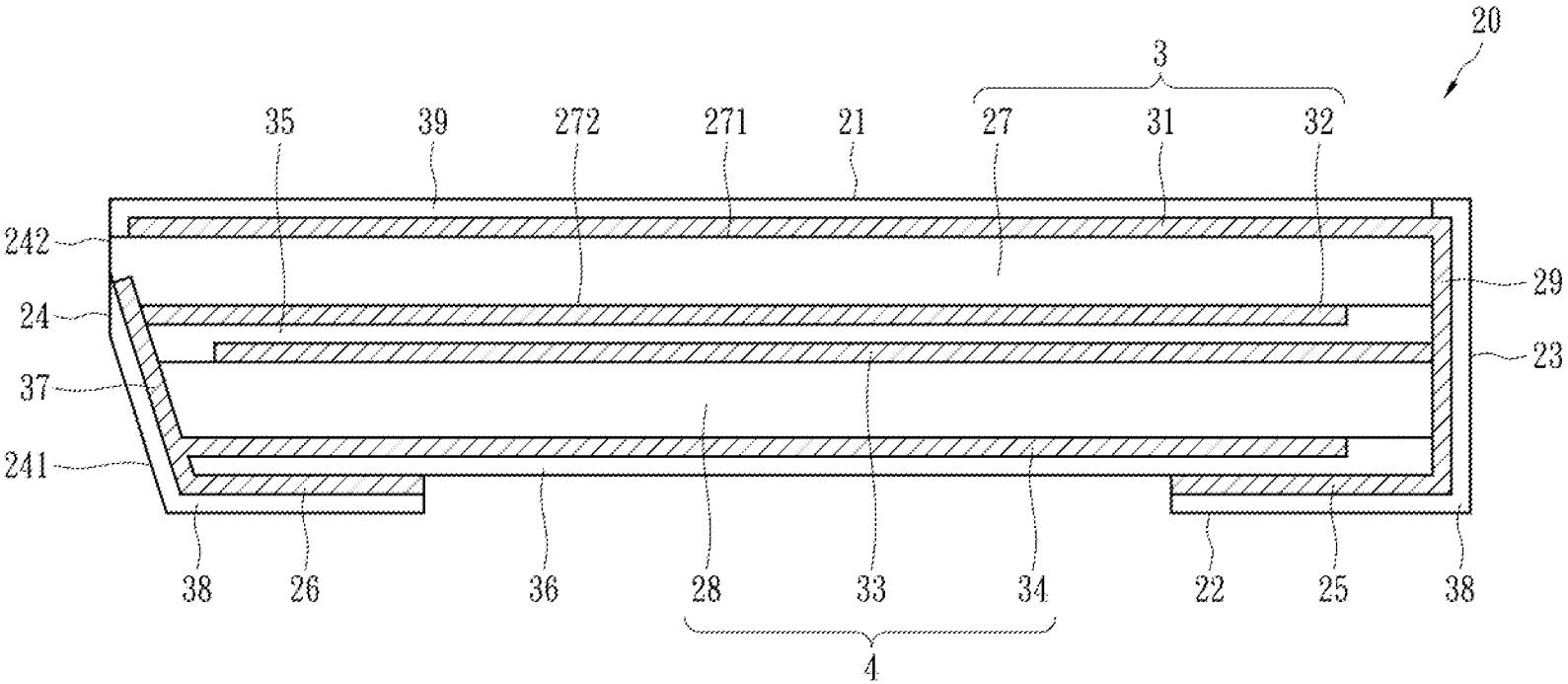
FIG. 2 shows an over-current protection device in accordance with a first embodiment of the present application.

FIG. 2 shows the cross-sectional view of an over-current protection device 20 in accordance with a first embodiment of the present application. The over-current protection device 20 is of an approximately quadrilateral structure with an upper surface 21, a lower surface 22, a first side surface 23 and a second side surface 24. The over-current protection device 20 comprises a first electrode 25, a second electrode 26, a first PTC material layer 27, a second PTC material layer 28, a first conductive connecting member 29 and a second conductive connecting member 37. The second electrode 26 and the first electrode 25 are insulated from each other and may serve as left and right electrodes, respectively, and therefore the over-current protection device 20 can be surface-mounted to a circuit board. In an embodiment, the electrode 25 or 26 may be a copper foil plated with a tin layer 38, i.e., a tin-plated copper foil, to increase soldering facilitation. The first and second electrodes 25 and 26 (including the tin layer 38) are formed on the lower surface 22. It should be noted that the electrodes 25 and 26 may be metal foils without the tin layer 38. The first PTC material layer 27 extends a long the upper surface 21, and the first PTC material layer 27 has opposite first surface 271 and second surface 272. A conductive member 31, e.g., an upper metal foil, is formed on the first surface 271 and is electrically connected to the first electrode 25. A conductive member 32, e.g., a lower metal foil, is formed on the second surface 272 and is electrically connected to the second electrode 26. In other words, the first PTC material layer 27 is laminated between the conductive members 31 and 32 to form a PTC device 3. Likewise, the second PTC material layer 28 is laminated between the conductive layer (upper metal foil) 33 and the conductive layer (lower metal foil) 34 to form another PTC device 4. The conductive member 33 is electrically connected to the first electrode 25, whereas the conductive member 34 is electrically connected to the second electrode 26. The first conductive connecting member 29 is formed on and extends along the first side surface 23, and electrically connects the conductive members 31, 33 and the first electrode 25. The second conductive connecting member 37 is formed on the second side surface 24, and electrically connects the conductive members 32 and 34 and the second electrode 26. More specifically, the second side surface 24 contains a bevel 241 and a vertical plane 242. The bevel 241 does not go through the entire side surface 24. In this embodiment, the second conductive connecting member 37 extends along the bevel 242, and is isolated from the conductive members 31 and 33. In an embodiment, the first conductive connecting member 29 maybe a semicircular plated through hole, and the second conductive connecting member 37 along the bevel 241 may be a planar conductive plate. The conductive connecting members 29 and 37 may be copper foils plated with tin layers 38 as well. The insulation layer 35 is formed between the conductive members 32 and 33 for insulation. The insulation layer 36 is formed between the conductive members 34 and the electrodes 25 and 26. In an embodiment, the insulation layers 35 and 36 may contain epoxy resin and glass fiber. In an embodiment, a solder mask 39 is disposed on the conductive member 31 to form the upper surface 21.

Figure 1:
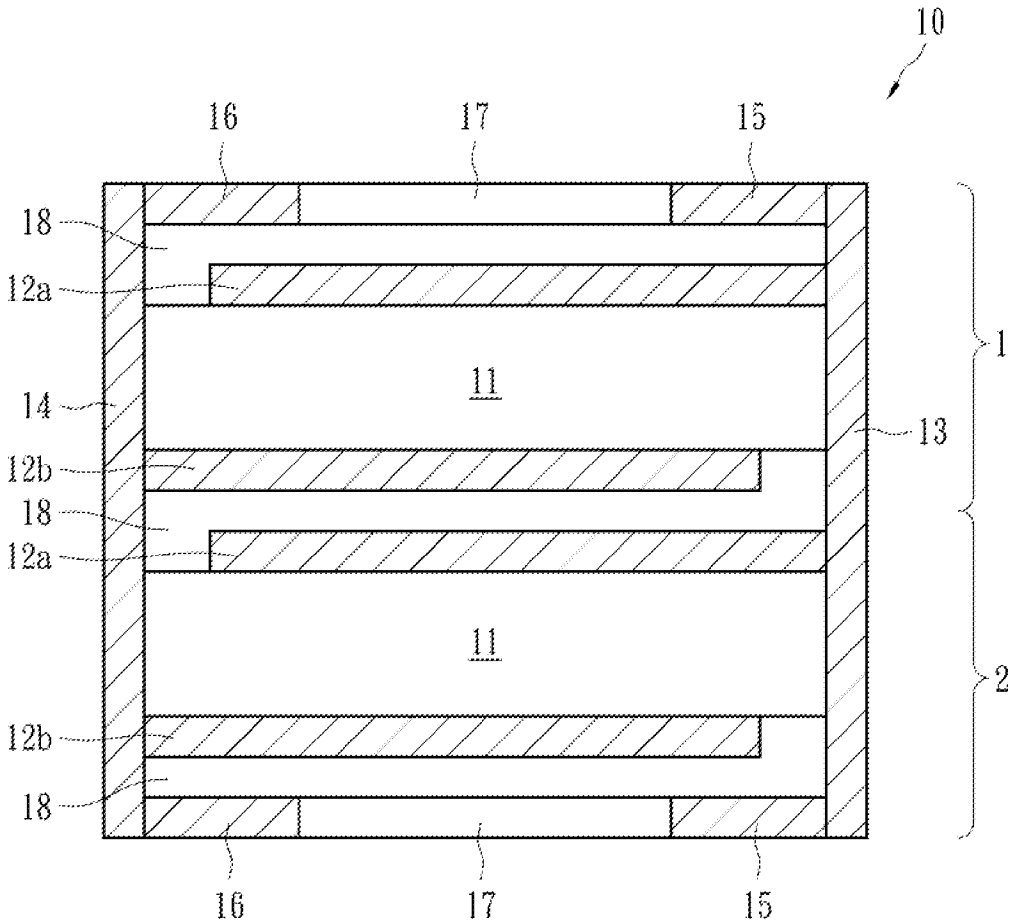
FIG. 1 (Prior Art)
FIG. 1 shows a known over-current protection device.

Compared to the need of three insulation layers 18 in FIG. 1, the over-current protection device 20 only needs two insulation layers 35 and 36. Accordingly, the thickness of the over-current protection device 20 can be limited to below 0.8 mm, or less than 0.75 mm or 0.7 mm in particular.

Figure 3A:
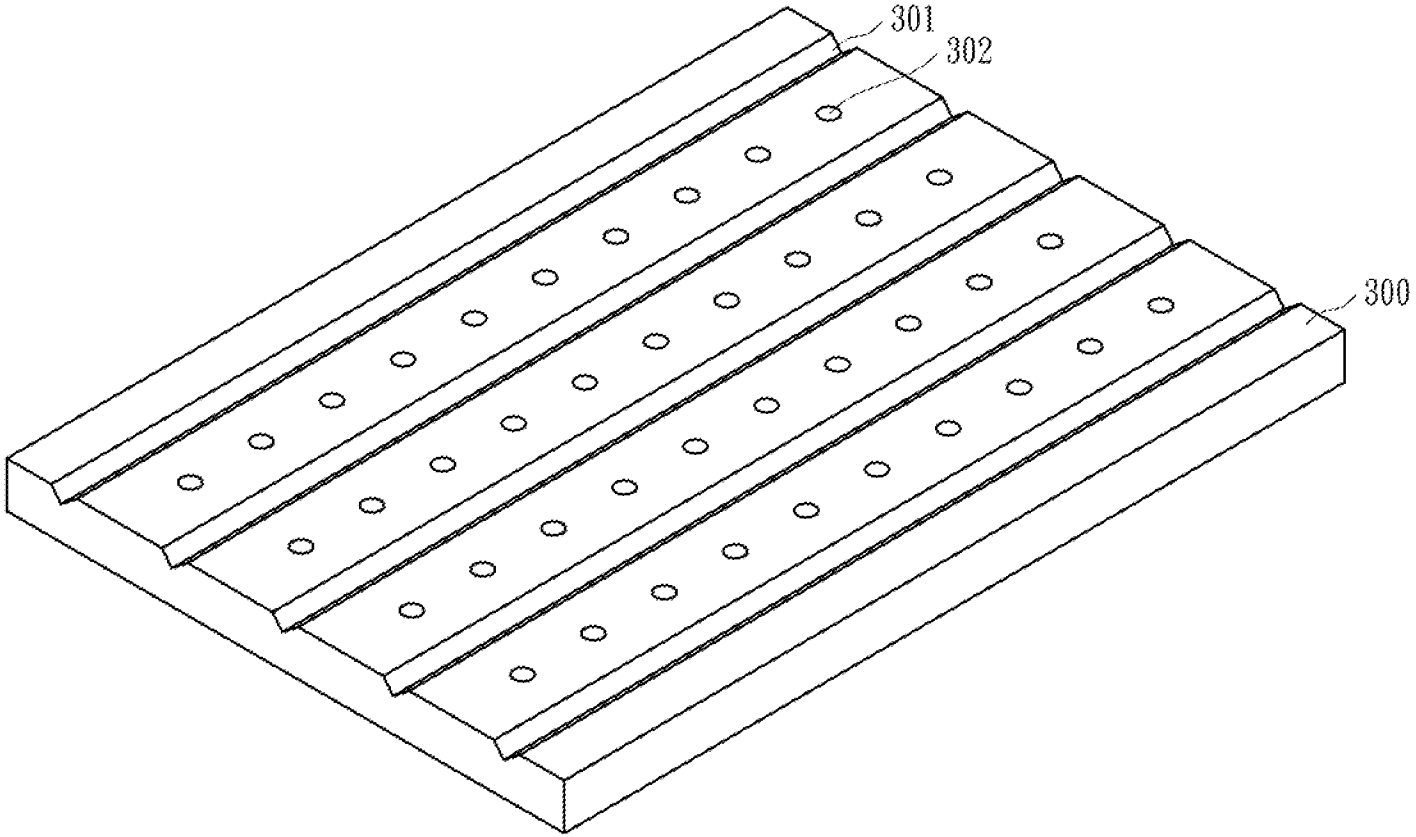
FIGS. 3A and 3B show a process of making an over-current protection device in accordance with the first embodiment of the present application.
Figure 3B:
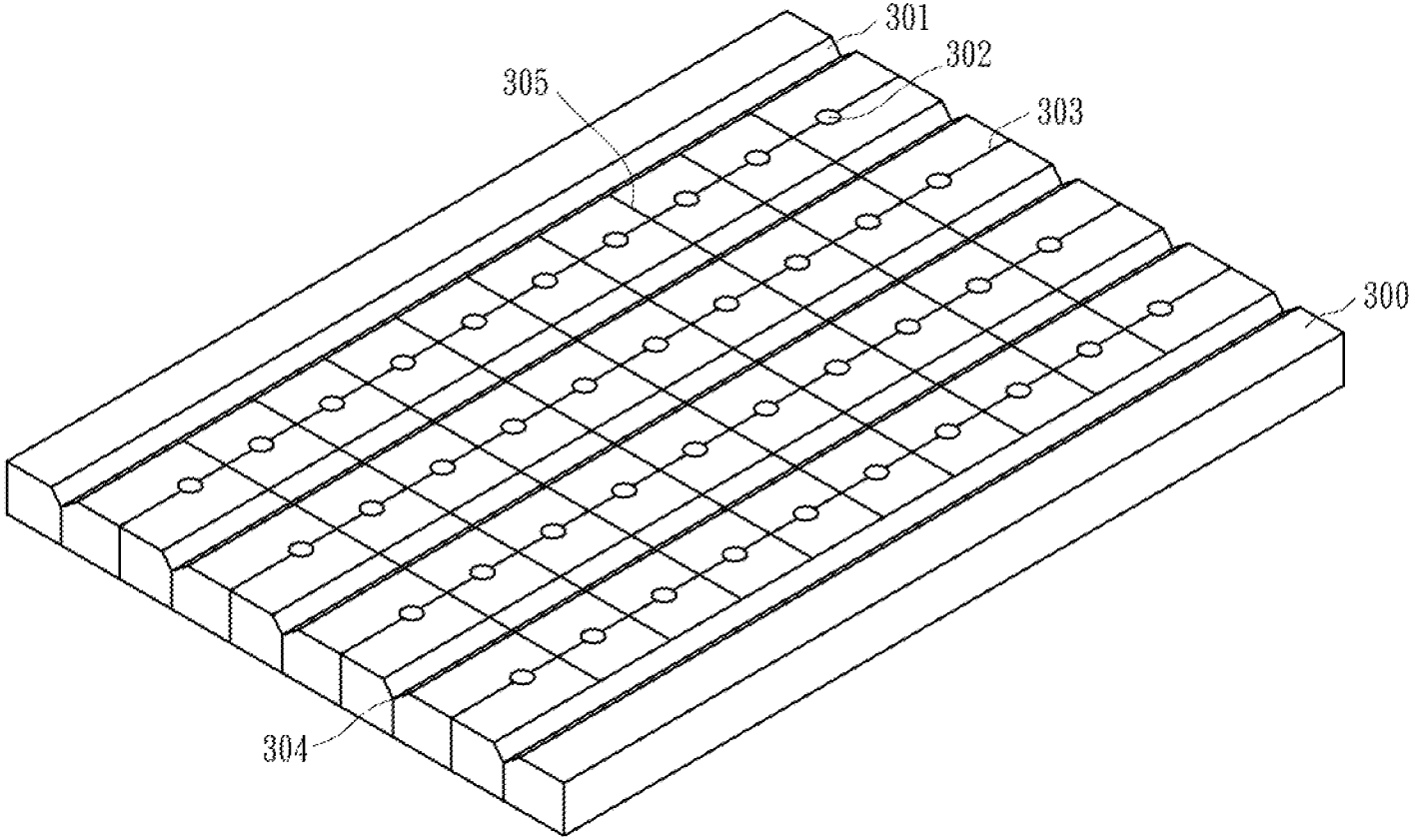

FIGS. 3A and 3B exemplify a process of making the over-current protection device 20. Grooves 301 and holes 302 with certain intervals are formed in a PTC composite substrate 300, and then the grooves 301 and the holes 302 are plated with conductive films to form conductive metal surfaces and conductive through holes. Preferably, the grooves 301 are of V or U shape. Sequentially, the PTC composite substrate 300 is cut into pieces along cutting lines 303, 304 and 305 to form the over-current protection devices 20. The cutting lines 303 go through the conductive holes 302; the cutting lines 304 go through the grooves 301; the cutting lines 305 are perpendicular to the cutting lines 303 and 304 and go through the center between every two adjacent conductive holes 302.

Figure 4:
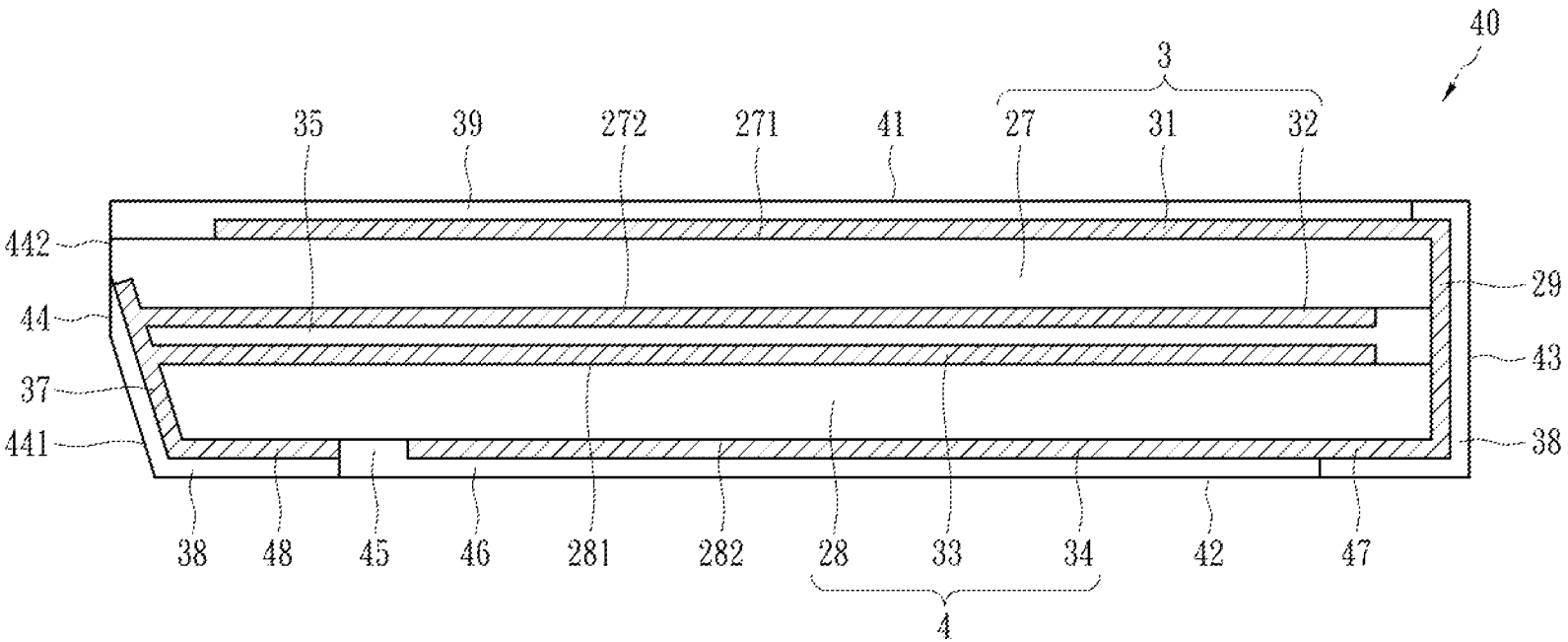
FIG. 4 shows an over-current protection device in accordance with a second embodiment of the present application

FIG. 4 shows another surface mountable over-current protection device of the present application. An over-current protection device 40 comprises an upper surface 41, a lower surface 42, a first side surface 43 and a second side surface 44. The over-current protection device 40 comprises a first electrode 47, a second electrode 48, a first PTC material layer 27, a second PTC material layer 28, a first conductive connecting member 29 and a second conductive connecting member 37. In this embodiment, the first PTC material layer 27 and the conductive members 31 and 32 are similar to those shown in FIG. 2, but the conductive member 34 below the PTC material layer 28 serve as an electrode directly. The first electrode 47 and the second electrode 48 are formed on a surface 282 of the second PTC material layer 28. A conductive member 33 is formed on another surface 281 of the second PTC material layer 28. The conductive member 33 is electrically connected to the second electrode 48 through the conductive connecting member 37. The conductive member 34 is connected to the conductive connecting member 29. The second PTC material layer 28 is laminated between the conductive member 33 and the conductive member 34. The insulation layer 35 is laminated between the conductive member 32 and the conductive member 33. A portion of the conductive member 34 is overlaid by a solder mask 46 which forms the lower surface 42. The portion of the conductive member 34 uncovered by the solder mask 46 serves the first electrode 47. In this embodiment, a first electrode 47 and the conductive member 34 maybe made from a same metal foil such as a copper foil, and are commonly formed on the same surface 282 of the second PTC material layer 28. An isolation line 45 can be formed between the conductive member 34 and the second electrode 48 by etching, and-may be filled with the solder mask 46. The second electrode 48 and the first electrode 47 serve as a left electrode and a right electrode, respectively, and can be surface-mounted to a circuit board. In an embodiment, the first electrode 47 or the second electrode 48 may be a copper foil plated with a tin layer 38, i.e., a tin-plated copper foil. Also, the conductive connecting members 29 and 37 may be further plated with tin layers 38.

Similarly, the second side surface 44 comprises a bevel 441 and a vertical plane 442. The second conductive connecting member 37 extends along the bevel 441, and is isolated from the conductive member 31. In an embodiment, the conductive member 31 is covered by a solder mask 39 which forms an upper surface 41.

Compared to the over-current protection device having two PTC layers as shown in FIG. 1, two insulation layers can be omitted to further decrease the thickness of the over-current protection device. The thickness may be less than 0.75 mm, or less than 0.7 mm or 0.65 mm in particular.

Figure 5:
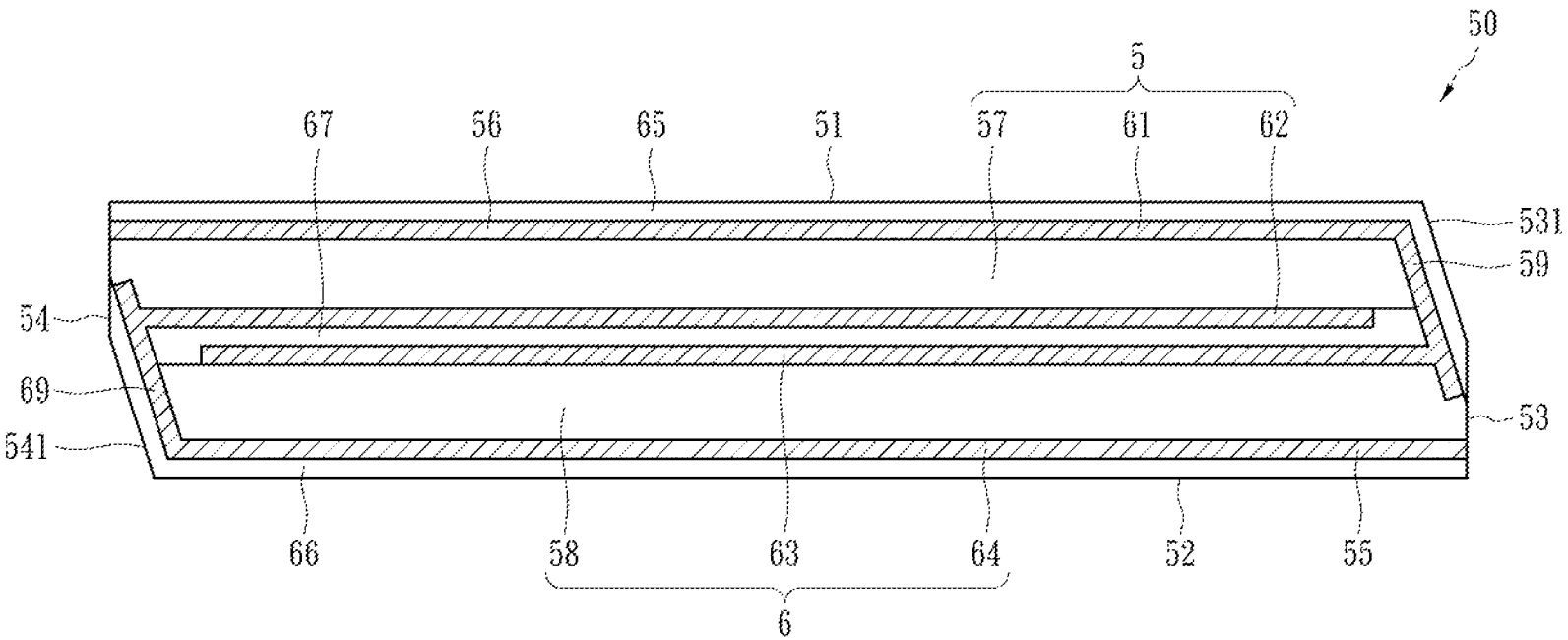
FIG. 5 shows an over-current protection device in accordance with a third embodiment of the present application.

FIG. 5 shows the cross-sectional view of the over-current protection device 50 in accordance with a third embodiment of the present application. The over-current protection device 50 can be connected to external leads. The over-current protection device 50 is of an approximately quadrilateral structure having an upper surface 51, a lower surface 52, a first side surface 53 and a second side surface 54. The over-current protection device 50 comprises a first electrode 56, a second electrode 55, a first PTC material layer 57, a second PTC material layer 58, a first conductive connecting member 59 and a second conductive connecting member 69. In this embodiment, the second electrode 55 is formed on the lower surface 52, the first electrode 56 is formed on the upper surface 51, and the first electrode 56 is insulated from the second electrode 55. The first electrode 56 and the second electrode 55 serve as an upper electrode and a lower electrode, respectively. The first PTC material layer 57 extends along the upper surface 51. More specifically, a conductive member (e.g., an upper metal foil) 61 is formed, on a surface of the PTC material layer 57 and serves as the first electrode 56, and a conductive member (a lower metal foil) 62 is formed on another surface of the PTC material layer 57 and is electrically connected to the second electrode 55 through the second conductive connecting member 69. The first PTC material layer 57 is laminated between the conductive members 61 and 62 to form a PTC device 5. Similarly, a conductive member (a lower metal foil) 64 is formed on a surface of the PTC material layer 58 and serves as the second electrode 55, and a conductive member (upper metal foil) 63 is formed on another surface of the PTC material layer 58 and is electrically connected to the first electrode 56 through the first conductive connecting member 59. The second PTC material layer 58 is laminated between the conductive members 63 and 64 to form a PTC device 6. The first conductive connecting member 59 is formed on the first side surface 53 and extends a long a bevel 531 of the first side surface 53. The first conductive connecting member 59 is electrically connected to the conductive members 61 and 63. The second conductive connecting member 69 is formed on the second side surface 54 and extends along a bevel 541 of the second side surface 54. The second conductive connecting member 69 is electrically connected to the conductive members 62 and 64. The insulation layer 67 is disposed between the conductive members 62 and 63 for insulation between the PTC device 5 and PTC device 6. In an embodiment, the first electrode 56 and/or the first conductive connecting member 59 may be a copper foil and may be plated with a tin layer 65 for soldering. Likewise, the second electrode 55 and/or the second conductive connecting member 69 may be a copper foil plated with a tin layer 66. According to this embodiment, the over-current protection device 50 only needs an insulation layer 67 and therefore the thickness can be limited to below 0.75 mm, or less than 0.7 mm or 0.65 mm.

Figure 6:
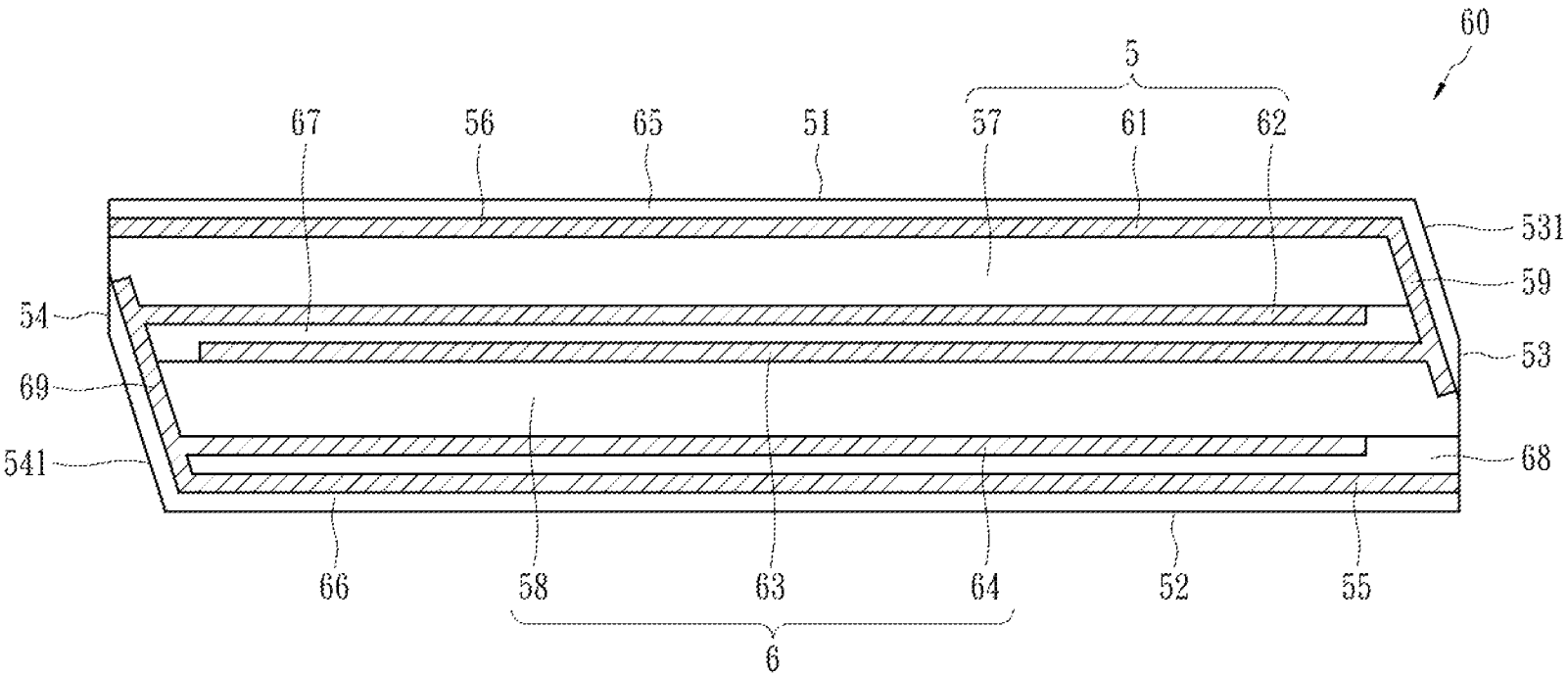
FIG. 6 shows an over-current protection device in accordance with a fourth embodiment of the present application.

FIG. 6 shows an over-current protection device 60 in accordance with a fourth embodiment of the present application. The over-current protection device 60 is of an approximately quadrilateral structure having an upper surface 51, a lower surface 52, a first side surface 53 and a second side surface 54. The over-current protection device 60 comprises a first electrode 56, a second electrode 55, a first PTC material layer 57, a second PTC material layer 58, a first conductive connecting member 59 and a second conductive connecting member 69. In this embodiment, the second electrode 55 is formed on the lower surface 52, and the first electrode 56 is formed on the upper surface 51. The first electrode 56 is insulated from the second electrode 55. The first electrode 56 and the second electrode 55 serve as an upper electrode and a lower electrode, respectively. The PTC device 5 containing a first PTC material layer 57 and conductive members 61 and 62 is similar to that shown in FIG. 5. The conductive member 61 serves as a first electrode 56. Similarly, a conductive member 64 is formed on a surface of the PTC material layer 58 and is electrically connected to the second electrode 55 through the second conductive connecting member 69. A conductive member 63 is formed on another surface of the PTC material layer 58 and is electrically connected to the first electrode 56 through the first conductive connecting member 59. The second PTC material layer 58 is laminated between the conductive members 63 and 64 to form a PTC device 6. The first conductive connecting member 59 is formed on the first side surface 53 and extends along a bevel 531 of the first side surface 53. The first conductive connecting member 59 is electrically connected to the conductive members 61 and 63. The second conductive connecting member 69 is formed on the second side surface 54 and extends along a bevel 541 of the second side surface 54. The second conductive connecting member 69 is electrically connected to the conductive members 62 and 64. The insulation layer 67 is disposed between the conductive members 62 and 63 for insulation. An insulation layer 68 is disposed between the conductive member 64 and the second electrode 55 for insulation. According to this embodiment, the over-current projection device 60 needs only two insulation layers 67 and 68 and therefore the thickness can be limited to below 0.8 mm, or less than 0.75 mm or 0.7 mm in particular.

Figure 7:
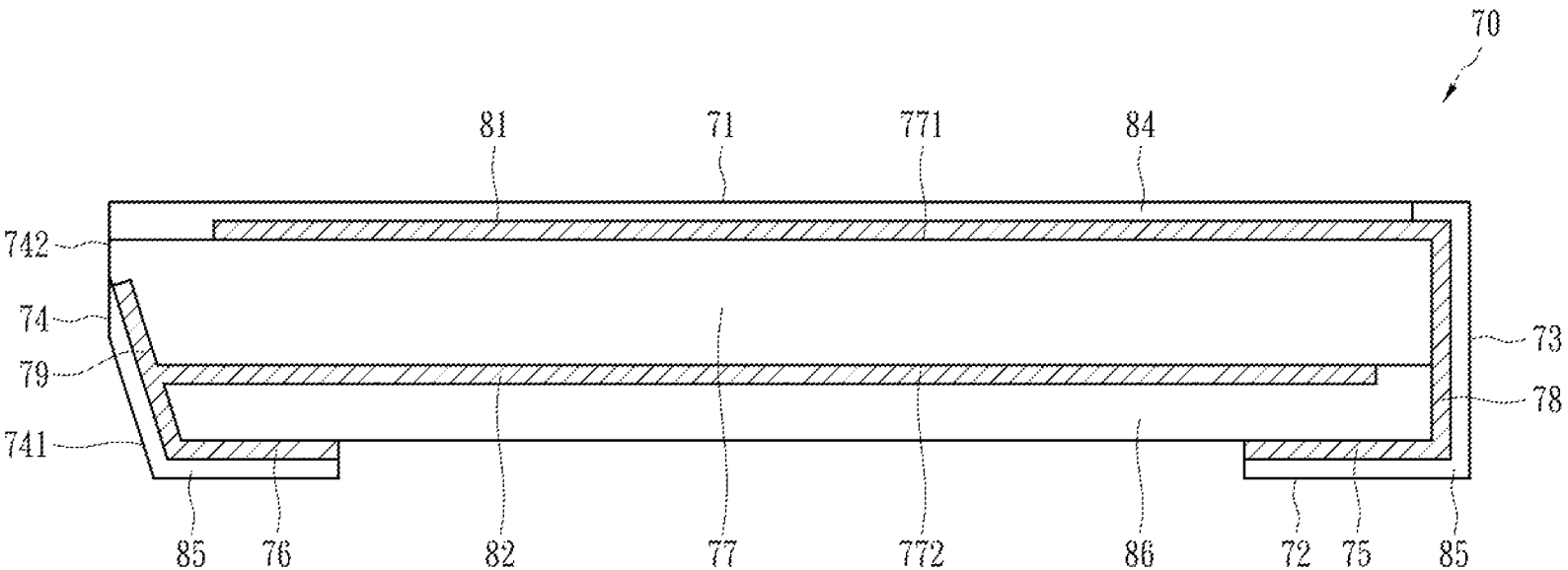
FIG. 7 shows an over-current protection device in accordance with a fifth embodiment of the present application.

In addition to the device having two PTC material layers, the present application can be applied to the structure including a single PTC material layer as shown in FIG. 7. The over-current protection device 70 is of an approximately quadrilateral structure having an upper surface 71, a lower surface 72, a first side surface 73 and a second side surface 74. The over-current protection device 70 comprises a first electrode 75, a second electrode 76, a PTC material layer 77, a first conductive connecting member 78 and a second conductive connecting member 79. In this embodiment, the first and second electrode 75 and 76 are formed on the lower surface 72, and the first electrode 75 is insulated from the second electrode 76. The first electrode 75 and the second electrode 76 serve as a right electrode and a left electrode, respectively, thereby the over-current protection device 70 is adaptive to surface-mount applications. In an embodiment, the electrode 75 and/or the electrode 76 may be a copper layer plated with a tin layer 85 for soldering facilitation. The PTC material layer 77 extends along the upper surface 71. The PTC material layer 77 has a first surface 771 and a second surface 772. A conductive member 81 is formed on the first surface 771 and is electrically connected to the first electrode 75 through the first conductive connecting member 78. A conductive member 82 is formed on the second surface 772 and is electrically connected to the second electrode 76 through a second conductive connecting member 79. The PTC material layer 77 is laminated between the conductive members 81 and 82. The first conductive connecting member 78 is formed on and extends along the first side surface 73, and electrically connects the conductive member 81 and the first electrode 75. The second conductive member 79 is formed on the second side surface 74 and electrically connects the conductive member 82 and the second electrode 76. In this embodiment, the second side surface 74 comprises a bevel 741 and a vertical plane 742. The bevel 741 does not go through the second side surface 74 completely. The second conductive connecting member 79 extends along the bevel 741, and is isolated from the conductive member 81. The insulation layer 86 is disposed between the electrodes 75, 76 and the conductive member 82. In an embodiment, a solder mask 84 is formed on the conductive member 81. The single PTC layer over-current protection device 70 contains only one insulation layer 86, and therefore it can meet the thin-type device requirements.

According to the thin-type design of the present application, the thickness of the over-current protection device can be decreased effectively and low resistance still can be sustained. Therefore, it is advantageous to be applied to various compact electronic apparatuses.

The above-described embodiments of the present invention are intended to be illustrative only. Numerous alternative embodiments may be devised by persons skilled in the art without departing from the scope of the following claims.

We claim:

1. An over-current protection device of an approximately quadrilateral structure with an upper surface, a lower surface, a first side surface and a second side surface in a cross-sectional view, the second side surface comprising a first bevel, the over-current protection device comprising:

a first electrode formed on the upper surface or the lower surface;

a second electrode formed on the lower surface and being insulated from the first electrode;

a first PTC material layer extending along the upper surface, and having a first surface electrically coupled to the first electrode and a second surface electrically coupled to the second electrode;

a first conductive connecting member formed on the first side surface, and being electrically coupled to the first electrode; and a second conductive connecting member formed on the second side surface and extending along the first bevel to electrically couple to the second electrode.

2. The over-current protection device of claim 1, wherein the first bevel does not go through the second side surface completely.

3. The over-current protection device of claim 1, wherein the second conductive connecting member comprises a planar conductive plate.

4. The over-current protection device of claim 1, further comprising a first conductive member and a second conductive member, the first and second electrodes being formed on the lower surface, the first PTC material layer being laminated between the first conductive member and the second conductive member, the first conductive member being connected to the first conductive connecting member, the second conductive member being connected to the second conductive connecting member, the first conductive member having a surface covered by a first solder mask to form the upper surface.

5. The over-current protection device of claim 4, further comprising an insulation layer disposed between the second conductive member and the first and second electrodes.

6. The over-current protection device of claim 4, further comprising:

a third conductive member connected to the first conductive connecting member;

a fourth conductive member connected to the second conductive connecting member;

a second PTC material layer laminated between the third conductive member and the fourth conductive member;

a first insulation layer disposed between the second conductive member and the third conductive member; and a second insulation layer disposed between the fourth conductive member and the first and second electrodes.

7. The over-current protection device of claim 4, further comprising;

a third conductive member connected to the second conductive connecting member;

a fourth conductive member connected to the first conductive connecting member;

a second PTC material layer laminated between the third conductive member and the fourth conductive member; and an insulation layer disposed between the second and third conductive members;

wherein the fourth conductive member partially covered by a second solder mask to form the lower surface.

8. The over-current protection device of claim 7, wherein a portion of the fourth conductive member uncovered by the second solder mask serve as the first electrode, and the second electrode and the fourth conductive member are disposed on a same surface of the second PTC material layer.

9. The over-current protection device of claim 8, wherein the fourth conductive member is insulated from the second electrode by an isolation line.

10. The over-current protection device of claim 1, wherein the first conductive connecting member is a plated-through-hole.

11. The over-current protection device of claim 1, wherein the over-current protection device has a thickness less than 0.7 mm.

12. The over-current protection device of claim 1, further comprising:

a first conductive member connected to the second conductive connecting member;

a second conductive member connected to the first conductive connecting member;

a second PTC material layer disposed between the second electrode and the second conductive member; and an insulation layer disposed between the first and second conductive members;

wherein the first electrode and the second electrode are formed on the upper and the lower surface, respectively, the first PTC material layer is laminated between the first electrode and the first conductive member, the first side surface comprises a second bevel along which the first conductive connecting member extends.

13. The over-current protection device of claim 1, further comprising:

a first conductive member connected to the second conductive connecting member;

a second conductive member connected to the first conductive connecting member;

a third conductive member connected to the second conductive connecting member;

a second PTC material layer laminated between the second and third conductive members;

a first insulation layer formed between the first and second conductive members; and a second insulation layer formed between the third conductive member and the second electrode;

wherein the first electrode and the second electrode are formed on the upper surface and the lower surface, respectively, the first PTC material layer is laminated between the first electrode and the first conductive member, the first side surface comprises a second bevel along which the first conductive connecting member extends.

14. An over-current protection device of an approximately quadrilateral structure with an upper surface, a lower surface, a first side surface and a second side surface in a cross-sectional view, the second side surface comprising a first bevel, the over-current protection device comprising:

a first electrode;

a second electrode;

a first conductive connecting member formed on the first side surface and being electrically connected to the first electrode;

a second conductive connecting member formed on the second side surface and being electrically connected to the second electrode;

a first PTC device;

a second PTC device disposed below die first PTC device; and a first insulation layer laminated between the first PTC device and the second PTC device;

wherein the first PTC device and the second PTC device are in parallel connection to the first and the second conductive connecting members, and the second conductive connecting member extends along the first bevel.

15. The over-current protection device of claim 14, wherein each of the first and second PTC devices comprises an upper metal foil and a lower metal foil and a PTC material layer laminated therebetween.

16. The over-current protection device of claim 15, wherein the first electrode and the second electrode are formed on the lower surface, the upper metal foils of the first and second PTC devices are connected to the first conductive connecting member, the lower metal foils of the first and second PTC devices are connected to the second conductive connecting member.

17. The over-current protection device of claim 16, further comprising a second insulation layer disposed between the second PTC device and the first and second electrodes.

18. The over-current protection device of claim 15, wherein the upper metal foil of the first PTC device is covered by a first solder mask, and a portion of the lower metal foil of the second PTC device is covered by a second solder mask, a portion of the lower metal foil uncovered by the second solder mask serves as a first electrode, and the second electrode and the lower metal foil of the second PTC device are formed on a same plane.

19. The over-current protection device of claim 18, wherein the first electrode and the second electrode is insulated by an isolation line.

20. The over-current protection device of claim 15, wherein the upper metal foil of the first PTC device serves as the first electrode, the lower metal foil of the second PTC device serves as the second electrode, the first side surface comprises a second bevel along which the first conductive connecting member extends.

21. The over-current protection device of claim 15, wherein the upper metal foil of the first PTC device serves as the first electrode, the second electrode Is formed on the lower surface, the lower metal foil of the second PTC device is insulated from the second electrode by a second insulation layer, the first side surface comprises a second bevel along which the first conductive connecting member extends.

22. The over-current protection device of claim 14, wherein the over-current protection device has a thickness less than 0.7 mm.

* * * * *